US005167199A

United States Patent [19]

Rehbein

[11] Patent Number: 5,167,199

[45] Date of Patent: Dec. 1, 1992

[54] SAILFLAG UNIT

[76] Inventor: Jurg Rehbein, 611 Broadway #538, New York, N.Y. 10012

[21] Appl. No.: 857,089

[22] Filed: Mar. 20, 1992

Related U.S. Application Data

[63] Continuation-in-part of Ser. No. 691,952, Apr. 26, 1991, abandoned.

[51] Int. Cl.[5] ..... G09F 7/22; G09F 17/00

[52] U.S. Cl. ..... 116/174; 116/173; 116/264; 40/479; 40/603; 40/617

[58] Field of Search ..... 116/173, 174, 264; 40/479, 603, 604, 617, 610, 218

[56] References Cited

U.S. PATENT DOCUMENTS

| | | | |
|---|---|---|---|
| D. 281,336 | 11/1985 | Ahigren | D20/21 |
| D. 294,272 | 2/1988 | Morris | D20/21 |
| D. 295,193 | 4/1988 | Visocky et al. | D20/10 |
| 305,098 | 9/1884 | Menefee | 40/479 |
| 2,336,927 | 12/1943 | Cross | 116/174 |
| 2,911,746 | 11/1959 | Frey | 40/604 |
| 3,237,592 | 3/1966 | Anderson | 116/173 |
| 3,239,957 | 3/1966 | Snediker | 116/173 |
| 3,477,161 | 11/1969 | Drexler | 40/218 |
| 3,513,577 | 5/1970 | Kleinman | 40/86 |
| 3,550,297 | 12/1970 | Friedrichsen | 40/128 |
| 3,589,048 | 6/1971 | Mollet et al. | 40/128 |
| 3,590,505 | 7/1971 | Benchley, Jr. | 40/33 |
| 3,594,934 | 7/1971 | Burnbaum | 40/33 |
| 3,638,341 | 2/1971 | Holmes | 40/39 |
| 3,645,026 | 2/1972 | Lorch | 40/218 |
| 3,665,625 | 5/1972 | Moss | 40/33 |
| 3,792,678 | 2/1974 | Rowland | 40/603 X |
| 3,798,808 | 3/1974 | Van Wagenen et al. | 40/33 |
| 3,798,816 | 3/1974 | Flaherty | 40/218 |
| 3,805,335 | 4/1974 | Lorch | 24/73 R |
| 3,899,843 | 8/1975 | Doyle et al. . | |
| 3,910,226 | 10/1975 | McGahee | 116/173 |
| 3,918,183 | 11/1975 | Poulos et al. | 40/33 |
| 3,964,189 | 6/1976 | Belokin, Jr. | 40/33 |
| 3,997,993 | 12/1976 | Flaherty | 40/218 |
| 4,195,910 | 4/1980 | Imes, Jr. | 350/167 |
| 4,353,179 | 10/1982 | Jennings | 40/479 |
| 4,392,316 | 7/1983 | Thomas | 40/610 X |
| 4,521,983 | 6/1985 | Wakatake | 40/473 |
| 4,612,720 | 9/1986 | Manners-Smith et al. | 40/211 |
| 4,615,131 | 10/1986 | Wakatake | 40/473 |
| 4,624,648 | 11/1986 | Waters | 116/264 X |
| 4,798,356 | 1/1989 | Alanso | 40/603 X |
| 4,906,503 | 3/1990 | De La Cruz et al. | 428/81 |
| 4,910,897 | 3/1990 | Hsu | 40/456 |
| 4,910,898 | 3/1990 | Hector | 40/479 |
| 4,912,442 | 3/1990 | Black | 340/764 |
| 4,937,962 | 7/1990 | Hornblad | 40/604 X |

*Primary Examiner*—William A. Cuchlinski, Jr.
*Assistant Examiner*—John L. Beres
*Attorney, Agent, or Firm*—Pennie & Edmonds

[57] ABSTRACT

A sailflag, consisting of a light weight frame and a light weight material mounted on it, is interposed between two swivels by means of cable units which run from both sides of the framework of the sailflag to the two swivels. The sailflag is caused to move in the wind around an axis which extends between the two swivels. The points of attachment for the swivels are located on a plane or on a pole.

20 Claims, 7 Drawing Sheets

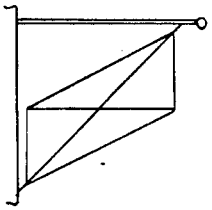
FIG. 6a1
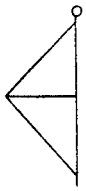
FIG. 6a2
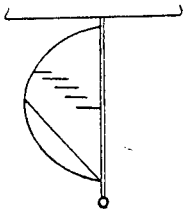
FIG. 6a3
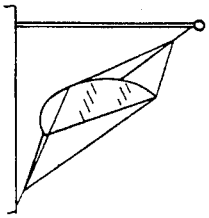
FIG. 6b1
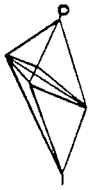
FIG. 6b2
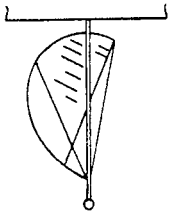
FIG. 6b3
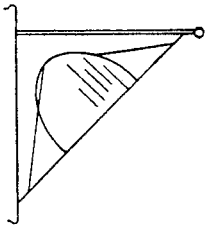
FIG. 6c1
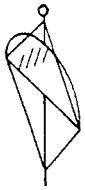
FIG. 6c2
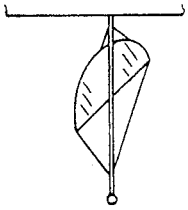
FIG. 6c3
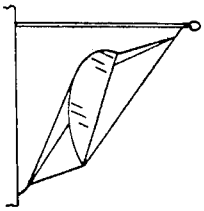
FIG. 6d1
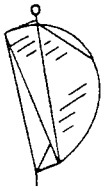
FIG. 6d2
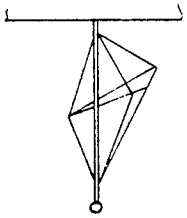
FIG. 6d3
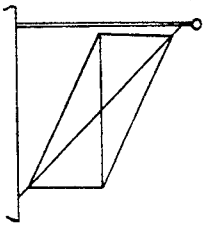
FIG. 6e1
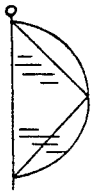
FIG. 6e2
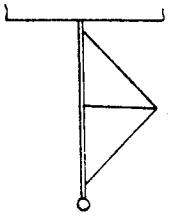
FIG. 6e3

SAILFLAG UNIT

This is a continuation-in-part of application Ser. No. 691,952, filed Apr. 26, 1991, now abandoned.

FIELD OF THE INVENTION

The invention relates generally to the field of moving sign exhibiting devices, particularly for uses in advertising displays. It is a hybrid between a flag, a banner and a mobile. The sailflag unit is an advertising display unit animated to rotate by the wind or adjust itself to the wind direction. It offers a moving sailflag surface on which different designs can be displayed.

BACKGROUND OF THE INVENTION

Flags or banners are well known media for the display of symbols communicating a desired message to an observer. These prior art objects rely on wind forces to fully display the symbol.

Typically, such a flag is joined to a stationary object at least at two points along one side, so that the area defined by the edges of the flag hangs freely. The flag is usually secured to a pole, which may be oriented in any desired fashion. A vertical pole causes the flag to become furled along the pole in the absence of a considerable wind force.

To remedy the inefficiency of vertical poles at displaying fully unfurled flags, it has been known to orient the pole horizontally, so that the surface of the flag is spread out visibly whether or not wind is present. However, these arrangements also suffer disadvantages.

Existing flags get wrapped around horizontal flagpoles attached to buildings. The edges of the flags wear out from whipping in the wind.

Existing banners are also subject to debilitating wear on the flanges of the flagpoles that have to hold existing banners in a fixed position against the wind force.

It is therefore an object of this invention to provide a flag display that is capable of attracting the viewer's attention, while providing improvements over existing sign exhibiting devices.

It is another object of this invention to provide a sailflag unit that adjusts itself to the wind, using the wind's force to move the sailflag around an axis.

It is a further object of this invention to provide a flag unit in which the flag component does not become entangled with its support.

It is another object of this invention to provide a flag unit in which the edges of the flag do not become worn from normal usage.

It is a further object of the invention to provide a moving sign exhibiting device that uses wind force with maximum efficiency.

It is still another object of the invention t provide a flag unit in which a wide variety of materials may suitably be used for the display portion, including both rigid and soft materials.

It is yet another object of the invention to provide a flag unit that is lightweight and adapted to easy interchange of signs and use in a variety of settings.

It is a further object of the invention to provide such a unit that is low in cost.

SUMMARY OF THE INVENTION

These and other objects of the invention that would be apparent to one skilled in the art are satisfied by the present invention, which comprises a sailflag having a light weight flag material stretched or mounted on a light weight frame. The flag material may be fabric, sheet metal or other suitable material. The frame may be fabricated from aluminum tubing, fiber-glass tubing or another suitable material.

The sailflag is suspended between two swivels by means of three or more rope or cable units (depending on the weight and size of the sailflag; the larger the flag, the more wind resistance and resulting force on the cables). The axis passing through the two swivels is the rotational axis of the sailflag unit. The two swivels are each attached to a supporting element on a plane or on a pole-like structure. The sailflag is adaptable to numerous spatial arrangements. For example, it can be stretched between a wall and the tip of a flagpole, or between the tip of a flagpole and the ground, or between a ceiling and a floor, and so on.

FIGS. *2a–c* show the sailflag of the first embodiment in a horizontal position in side, front, and top views, respectively.

Figure 3:
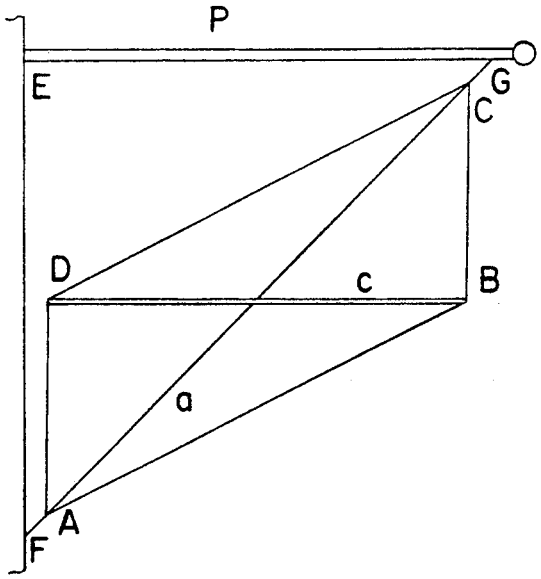
Figure 4:
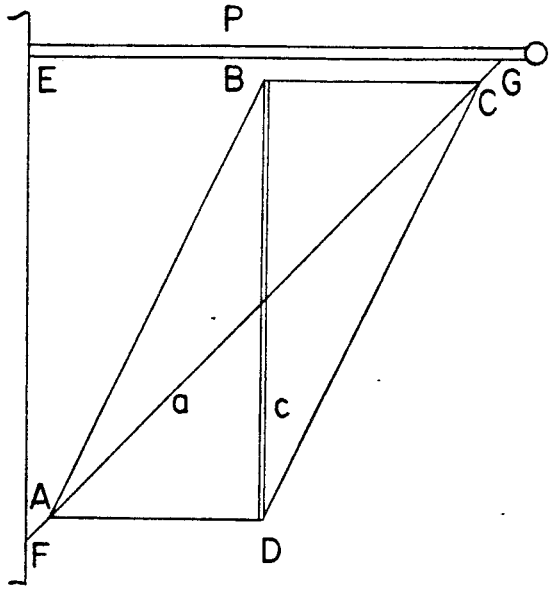
Figure 5:
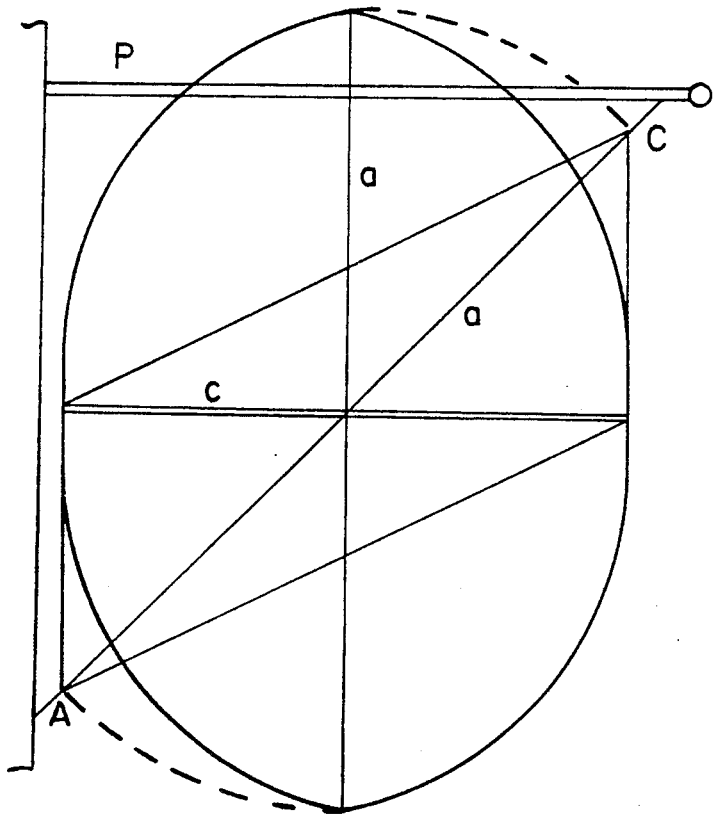
Figure 7:
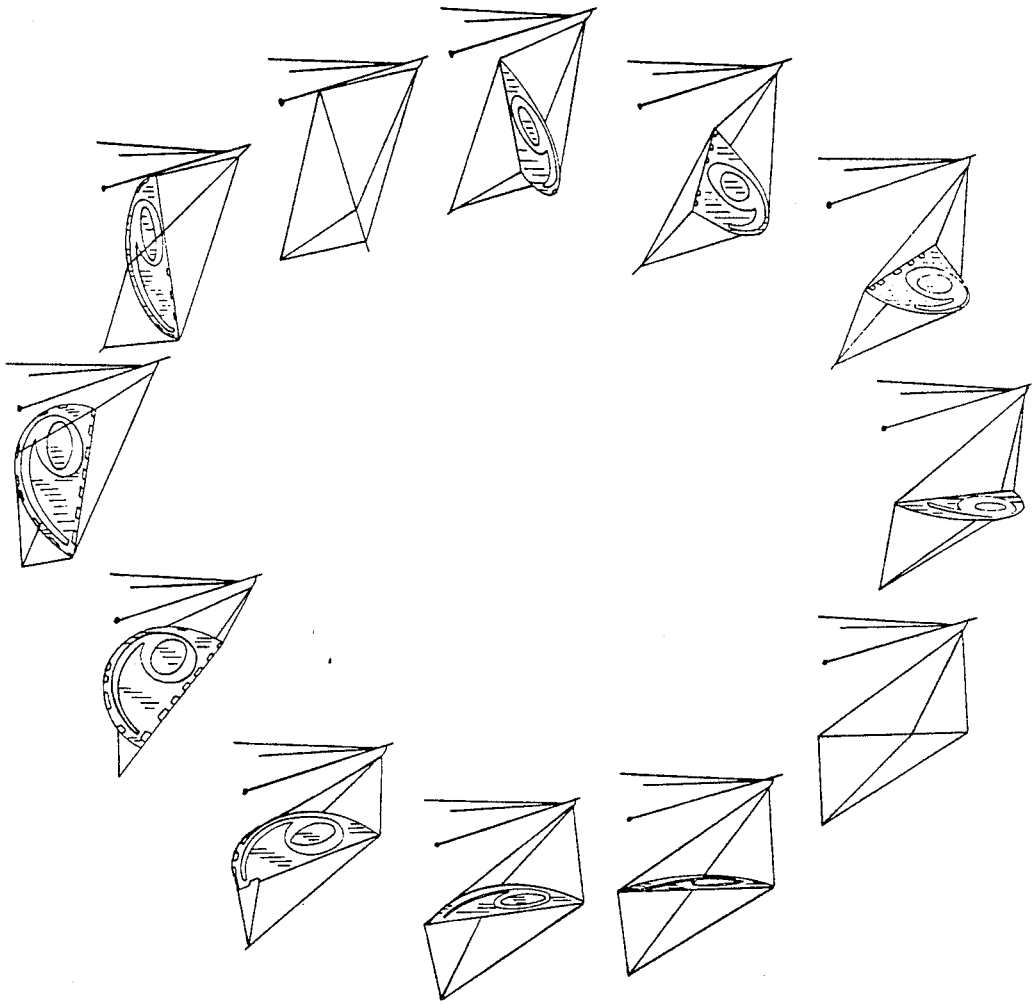
Figure 8:
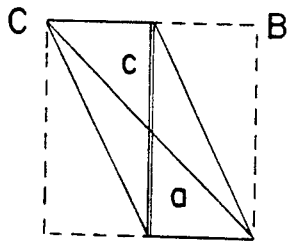
Figure 9:
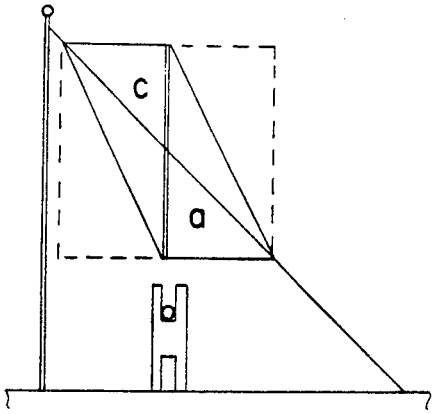
Figure 10:
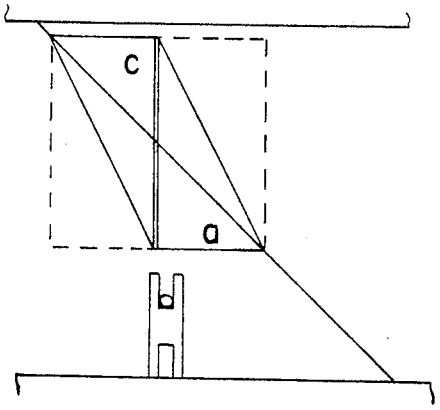
Figure 11:
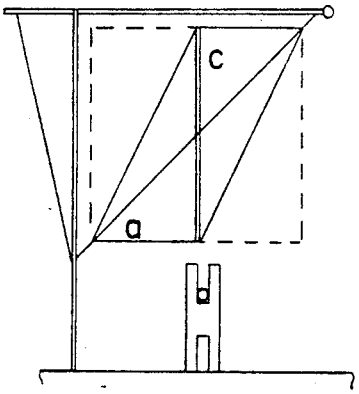
Figure 12:
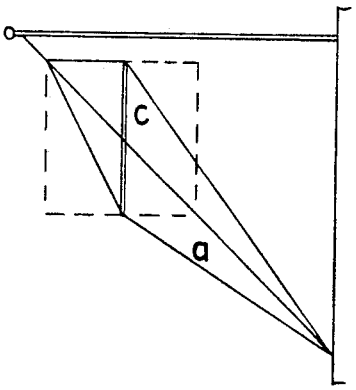
Figure 13:
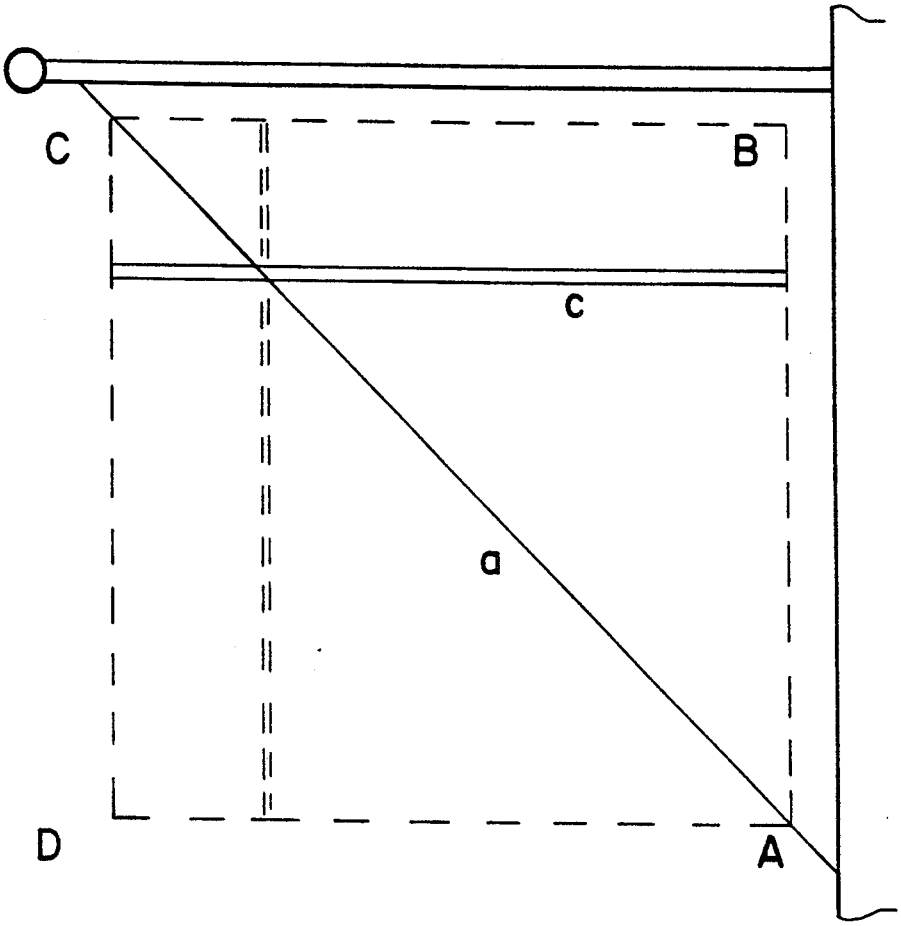
Figure 14:
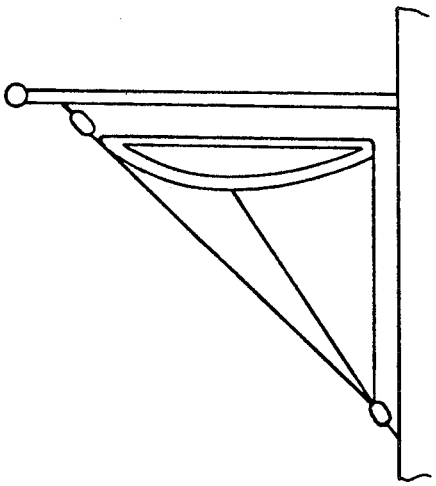
Figure 15:
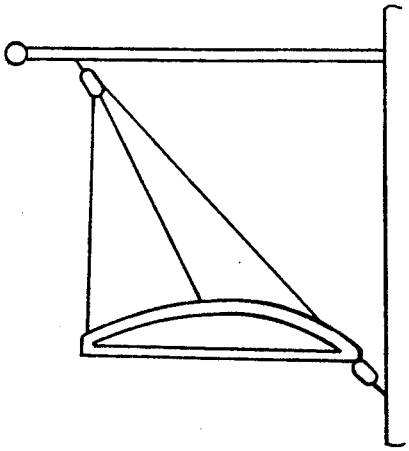

FIG. 3 is a side view of the sailflag of the first embodiment in the horizontal position;

FIG. 4 is a side view of the sailflag of the first embodiment with the sailflag in the vertical position;

FIG. 5 is a side view of a second embodiment of the present invention mounted as in the first embodiment and with the sailflag being of the largest elliptical shape possible for this unit;

FIG. *6a–e,* show the first embodiment of the invention rotated clockwise through 180° at 45° intervals (side, front and top view of each position);

FIG. 7 shows the first embodiment of the invention rotated through 360° at 30° intervals, and having a semicircular sailflag with a number 9 as a design on it;

FIG. 8 is a side view of the principal construction of all sailflag units;

FIG. 9 is an illustration of a third embodiment of the invention, with the sailflag mounted to a vertical flagpole and the ground;

FIG. 10 is an illustration of a fourth embodiment of the invention, with the sailflag mounted to a ceiling and the ground;

FIG. 11 is an illustration of a fifth embodiment of the invention, with the sailflag mounted to a vertical flagpole and horizontal crossbar;

FIG. 12 is an illustration of a sixth embodiment of the invention, mounted as in the first embodiment and having a smaller crossbar;

FIG. 13 is an illustration of a seventh embodiment of the invention, wherein the cross-bar is mounted so that the rotational axis does not pass through its center; and FIGS. 14 and 15 are illustrations of an eighth embodiment of the invention where one end of the crossbar is attached to the upper and lower swivel, respectively.

DETAILED DESCRIPTION OF THE PREFERRED EMBODIMENT

As used in the present description, the term sailflag unit refers to the whole unit including the cables, pole and the frame with a light weight material stretched on it. The term sailflag refers only to the light weight material including the frame on which it is mounted.

Figure 1:
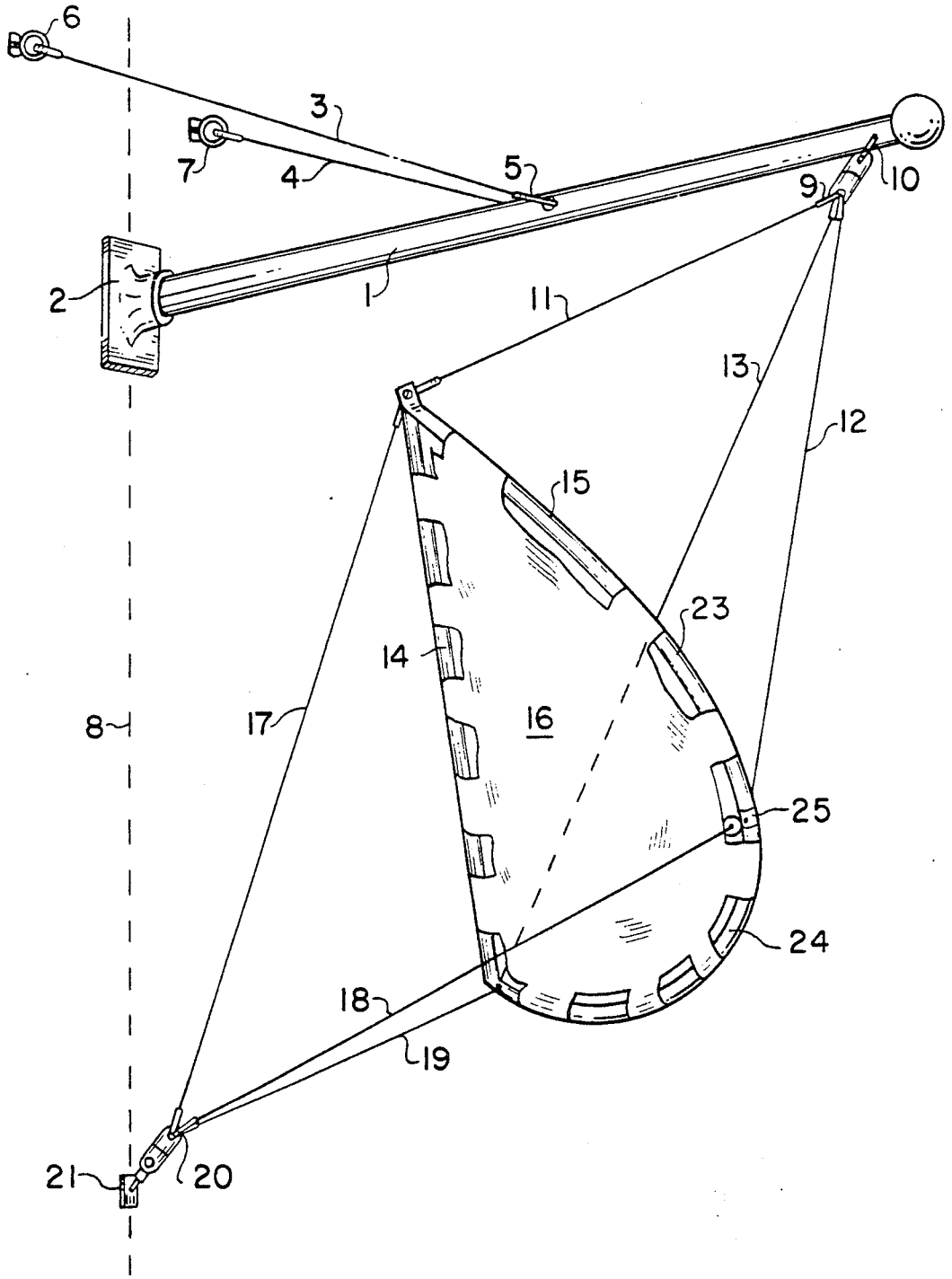
FIG. 1 is a perspective view of a first embodiment of the invention, with the sailflag mounted to a vertical wall and a horizontal flagpole, and with the shape of the sailflag being a semi-circle.

Referring to FIG. 1, there is depicted a sailflag unit which comprises a hollow, tubular flagpole 1 made from aluminum, fiber-glass or any other suitable material The flagpole 1 is mounted at a 90 degree angle to a wall by means of a flange 2 or another suitable wall fixture and secured by two cable units 3 and 4 (or rigid metal bars, rods, tubes or other suitable support for the flagpole 1) which are attached to the flagpole 1 by means of an eye bolt 5 in the flagpole 1 and cable fittings which secure the cable units 3 and 4 to the eye bolt 5, or any other suitable fastening means.

The cable units 3 and 4 are attached to the flagpole 1 at approximately two-thirds of the length of flagpole 1 away from the wall, and run to two points 6 and 7 on the wall above the flange 2. Points 6 and 7 are approximately half a pole length away from the flange 2 at a 45 degree angle to the center line 8 and on opposite sides of the center line s (the center line 8 is a vertical on the wall passing through the center of the flange z and through the bottom attachment 21 of the sailflag unit).

Swivel 9 may be, for example, an eye to eye swivel, in which case it is attached to the flagpole 1 with an eye bolt 10. Other swivels can be attached by other suitable fastening means. Secured to the swivel by means of swaged eye fittings or other suitable cable fittings, are three cable units 11, 12 and 13, which run to the frame of the sailflag.

The frame of the sailflag consists of the cross bar 14, which is suspended between two pairs of cable units (11, 17, and 13, 19) in a manner described below. A semi-circular piece of tubing 15 comprised of two shaping subsections 23 and 24 is attached to the cross bar 14 to give the sailflag the shape of a semi-circle. The cable units 11, 12 and 13 are attached to the frame with suitable cable fittings. The length of the cable units 11, 12 and 13, and 17, 18 and 19, and the principle of attaching them to the frame, will be described below.

The light weight material 16 of the sailflag, on which a design can be displayed, is mounted on the frame. Attached to the bottom of the frame are three or more cable units 17, 18 and 19, and at the same points 11, 12 and 13 are attached to the top of the frame by means of suitable cable fittings 17, 18 and 19 run to a swivel 20 which is secured to an eye bolt 21 by suitable fastening means. The eye bolt 21 is anchored in the wall on the center line 8 at the same distance away from the flange 2 as the eye bolt 10 is away from the flange 2. Variations of the flagpole-wall variation are based on the same principal construction and are mentioned below.

Figure 2A:
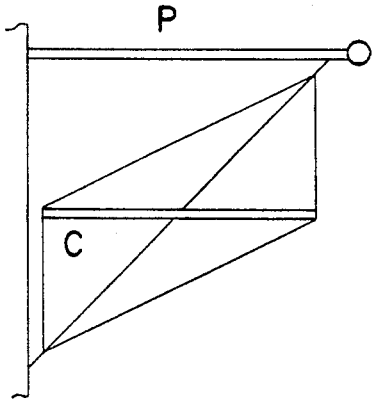

The procedure of installing a sailflag between two swivels is divided into two major steps. In the first step the cross bar c is suspended as shown in FIG. 2*a* (side view) between two cables. The cross bar c is a piece of light-weight tubing. It is held in its position by the tension of the cables to which it is fixed in two specific points which will be defined later. The cross bar c is in most variations a straight piece of tubing to maximize the resistance against the force of the tensioned cables pushing in on the crossbar c and to maximize the sailflag surface.

Figure 2B:
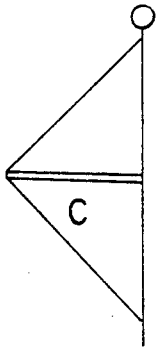
Figure 2C:
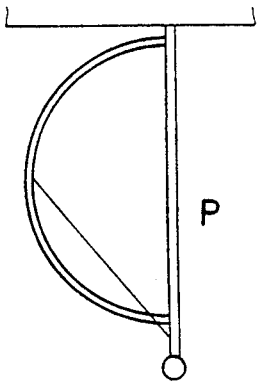

In the second step a semi-circular section of light-weight tubing, of the same material as the crossbar, is attached to the crossbar c to create a semi-circular framework upon which the light-weight material (fabric or sheetmetal or any other suitable material) can be stretched. To find the length of the two cable units which are attached to the semi-circular piece of tubing of the framework of the sailflag, crossbar c is held in the horizontal position and the semi-circular piece of tubing is attached to the crossbar c so it forms a 90 degree angle to the plane formed by the crossbar c and the flagpole p and the two cable units are attached to the center of both sides of the semi-circular piece of tubing in this position (FIG. 2*b, c* front and top views.).

Regarding the installation of the crossbar c, FIG. 3 shows a side view of the sailflag unit with the sailflag in a horizontal position, and FIG. 4 shows the sailflag in the vertical position. At point G, one swivel is anchored into the flagpole p, and at point F, the other swivel is anchored into the wall. The distance between E and G has to be equal to the distance between E and F. The line which goes through F and G is the imaginary rotational axis a of the sailflag. The cables are attached to the swivels at two points A and C.

The crossbar c is suspended by the cables between D and B. If the shape of the sailflag is a semi-circle its diameter is the length of c. D is halfway between E and F at approximately 1/20 of the length of c away from the wall. When the sailflag is in the vertical position as depicted in FIG. 4, B is also about 1/20 of c away from the flagpole p. This makes c approximately 9/10 of the distance between E and G. The distance between C and B is equal to the distance between A and D, and accordingly the crossbar c can be suspended in the parallelogram ABCD.

Holding the parallelogram ABCD in the same plane as the triangle EFG with c being in the horizontal position, c becomes the diameter of the semi-circle, which can be mounted, as described before, horizontally extending out to either side of c and secured by two (or more) cable units, running from A and C to the center of the semi-circular piece of tubing. The length of c depends on the distance between D and the wall, and B and the flagpole p which depend on the expansion rate of the cable under tension (wind) and the flexibility of the flagpole. With this mounting system a variety of shapes can be fixed to the crossbar c.

FIG. 5 depicts the largest shape that can be mounted on the crossbar c which is an ellipse with c as its short axis and the distance between A and C, the rotational axis a as its long axis d. Any shape of a sailflag inside or at this parameter can rotate without touching the wall or the flagpole p. But to use the sailflag in the wind it is advisable to use shapes that fit into one half of the ellipse with c being the dividing line. The reason for this is that the wind force acting on each half of the sailflag will make each half tend to rotate in opposite directions, which will cancel out the rotation and put stress on the structure of the sailflag unit (cable units, flange, swivels etc.).

The attaching of all shapes within the above parameter, consisting of one or more sections of light-weight tubing, to the crossbar c, works the same way as the mounting of the semi-circular section of the tubing to the crossbar c as described above. The crossbar c is held in the horizontal position and the desired shape of one or more sections of tubing is mounted in a right angle to the plane described by the crossbar c and the flagpole p. Then two or more pairs of cable units are attached to both sides of the section of tubing which is attached to c, to secure the section of tubing in the described position relative to the crossbar c.

The amount of cable units can be chosen differently. The minimal amount of cables that have to be used for proper functioning of the sailflag unit was described earlier. Instead of the six cable sections used, more sections of cables with a thinner diameter can be attached to different points of both sides of the same framework of the sailflag and run to the same swivels as described earlier.

If a shape consists of several sections of tubing, it is advisable to support the points where the different sections of tubing meet with a pair of cable units, one cable unit attached to the bottom and the other to the top of the joint of the sections of tubing, with each cable unit running to a swivel from there.

As illustrated in FIG. 1, shaping subsections 23 and 24 meet at joint 25. Cable 12 supports joint 25 from above while cable 18 supports joint 25 from below. Therefore, the two subsections 23 and 24 are supported at either end of each subsection, while joint 25 is supported from both above and below.

Relative to the length of the flagpole and the length of the cable units, the size of the sailflag is very large and the simplicity of the construction does not distract in the least from the original advertising function of the sailflag.

The sailflag acts like sails familiarly used on boats. Instead of a regular sail being fixed in a certain position to a mast to move a boat through water, the sailflag of the present invention itself moves in the wind. The sailflag adjusts itself to the wind and is able to rotate in strong winds.

In FIGS. 6*a–e* there are depicted side, front and top views (from left to right) of the 5 positions (from (a) to (e)) of a 180 degree clockwise rotation of the sailflag with 45 degree intervals. The sailflag is suspended horizontally at 0 degrees and vertically at 180 degrees. It is possible for the sailflag to move from a horizontal to a vertical position because the crossbar c is mounted at a 45 degree angle to the rotational axis a of the sailflag unit. This 45 degree (non-90 degree) position of the sailflag to the rotational axis a enables the sailflag to be propelled by the wind around axis a.

FIG. 7 depicts 12 positions of a 360 degree rotation of a sailflag with a number "9" as a design on it. The first Position (1) in FIG. 7 shows the sailflag suspended with no wind influence. In case of wind the sailflag can take any position from vertical to horizontal and thereby adjust itself to the wind direction, which enables the sailflag to display the design in many different directions. In case of a stronger wind the sailflag is also able to rotate.

Numerous arrangements may be selected for the present invention, according to spatial constraints, available support surfaces, and aesthetic desires. A primary factor in the orientation of the sailflag is the combination of the two chosen, supporting elements to which the cables coming from the sailflag are secured.

FIG. 8 shows the principal construction on which all sailflag unit variations are based. The sailflag is suspended, as described above, between the two opposing corners of an imaginary square ABCD, no matter which embodiment is chosen. The diagonal between the two corners A and C is the rotational axis a of the sailflag unit. Variations of the same principal construction of the sailflag unit are described below, with the imaginary square ABCD indicated in the corresponding drawings.

As depicted in FIG. 9, the vertical flagpole-ground variation is the same as the horizontal flagpole-ground variation rotated around 90 degrees with the wall becoming the ground. For safety reasons, the ground attachment is preferably moved up along the rotational axis a to prevent the sailflag from hurting anybody walking beneath it. This distance will be approximately 14 feet, calculated as the maximum reach of a person multiplied by the square root of two. FIG. 9 depicts the sailflag in the vertical position to show how the lowest level that the sailflag can reach is above the maximum reach of a person.

The embodiment of FIG. 10 is similar to the previous embodiment, with the vertical flagpole replaced by a ceiling as a supporting element.

The embodiment of FIG. 11 is similar to that of FIG. 6, with wall as a supporting element being replaced by a vertical flagpole.

If the cross bar c is smaller than approximately 9/10 of the distance between the location where one swivel is attached to the flagpole and the location where the flagpole is anchored into the wall, it can be moved up or down between the two swivels. As depicted in FIG. 12, the imaginary rotational axis a always passes through the center of the crossbar c and the cable units are attached to the crossbar c accordingly. The shapes of the sailflag which can be attached to the crossbar c depend on where the crossbar c is located. The selected shape will be fixed to the crossbar c and two or more cable units attached to both sides of the shape, each running to one swivel. The length of the cables is determined by holding the crossbar c in a horizontal position and mounting the shape in a right angle to the plane described by the crossbar c and the imaginary rotational axis a.

As depicted in FIG. 13, the cross bar c can be mounted with the rotational axis a not passing through its center. The cross bar c can be mounted at any point along the rotational axis a parallel to either one pair of opposing sides of the imaginary square ABCD. FIG. 13 depicts one such placement with the cross bar c in the horizontal position. The dotted line depicts the same cross bar c in the vertical position which is the mirror image of the horizontal position. The rotational axis a is also the mirror axis a. The cross bar c can be mounted horizontally anywhere along the rotational axis a as long as the two end points of the cross bar c in the horizontal position stay within the imaginary square ABCD. The cross bar c mounted horizontally within the imaginary square ABCD and parallel to the two opposing sides AD and BC with the rotational axis a passing through the cross bar c accordingly is able to rotate around the rotational axis a without interfering with the supporting elements from which it is suspended.

FIGS. 14 and 15 show the extreme mounting variations of the cross bar c at the corners A and C of the imaginary square ABCD. Any shape attached to this cross bar by means of three or more pairs of cable units must be angled to the imaginary square ABCD when the cross bar c is in a horizontal position, so as to not interfere with the supporting elements when the sailflag is rotating around the rotational axis a. As described above, six or more cable sections leading from the frame of the sailflag to the two swivels can be used in this variation. In the two extreme positions depicted in FIGS. 14 and 15 only 3 cable sections are necessary since one end of the cross bar c is directly attached to the swivel.

There are many more variations of the sailflag unit, for example more than one sailflag suspended from one flagpole, but all are based on the same principal construction as described and claimed herein.

I claim:

1. A sign exhibiting apparatus, comprising:

a sailflag having a frame and a display material joined to the frame, the frame comprising a rigid, substantially straight crossbar and at least one rigid shaping section, wherein the crossbar has a first end and a second end, the first end of the crossbar is connected to the first end of the shaping section, and the second end of the crossbar is connected to the second end of the shaping section, and wherein the display material occupies at least part of an area defined by the frame;

a first set of at least three support members joined to the frame and extending to a first mounting location;

a second set of at least three support members joined to the frame and extending to a second mounting location;

means for mounting the first set of support members to a first stable surface at the first mounting location; and means for mounting the second set of support members to a second stable surface at the second mounting location.

2. The apparatus of claim 1, wherein each of the first and second sets of support members includes a first support member joined to the frame at the first end of the crossbar and a second support member joined to the frame at the second end of the crossbar.

3. The apparatus of claim 2, wherein each of the first and second sets of support members includes a third support member joined to the shaping section of the frame.

4. The apparatus of claim 1, wherein the shaping section is a semicircle.

5. The apparatus of claim 1, wherein the shaping section is elliptical.

6. The apparatus of claim 1, wherein the shaping section comprises at least two rigid members joined at one or more joints.

7. The apparatus of claim 6, wherein each of the first and second sets of support members includes a first support member joined to the frame at the first end of the crossbar and a second support member joined to the frame at the second end of the crossbar and additional support members joined to the shaping section at each of the joints.

8. The apparatus of claim 1, wherein the second stable surface is a pole fixed to the first stable surface.

9. The apparatus of claim 1, wherein the first stable surface is a first pole and the second stable surface is a second pole fixed to the first pole.

10. A sign exhibiting apparatus, comprising:

a sailflag having a frame and a display material joined to the frame, the display material occupying at least part of an area defined by the frame;

a first set of at least three cables joined to the frame and extending to a first end of a first swivel, the first swivel having a second end mounted to a first stable surface;

a second set of at least three cables joined to the frame and extending to a first end of a second swivel, the second swivel having a second end mounted to a second stable surface.

11. The apparatus of claim 12, wherein the display material is soft and flexible.

12. The apparatus of claim 12, wherein the display material is substantially rigid.

13. The apparatus of claim 12 wherein the first and second stable surfaces are stationary.

14. The apparatus of claim 12, wherein the first stable surface is a first pole mounted to a third stable surface, and the second stable surface is a second pole fixed to the first pole in a substantially perpendicular relationship.

15. The apparatus of claim 12, wherein the frame comprises a substantially rigid crossbar and a substantially rigid shaping member joined to the crossbar, and wherein each of the first and second sets of cable includes two cables joined to the crossbar.

16. The apparatus of claim 17, wherein the length of the crossbar is less than 9/10 of the distance between the first and second swivels.

17. A sign exhibiting apparatus, comprising:

a sailflag having a frame and a display material associated with the frame, the display material occupying at least part of an area defined by the frame;

a first set of at least three support members joined to the frame and extending to a first mounting location;

first swivel means for mounting the first set of support members to a first stable surface at the first mounting location; and second swivel means for mounting the frame at a second mounting location to a second stable surface.

18. The apparatus of claim 17 wherein the sailflag completely rotates about its longitudinal axis without interfering with the first and second stable surfaces and mounting locations; the frame includes a crossbar and a shaping section, each having a first end and a second end, with the first end of the crossbar connected to the first end of the shaping section, and the second end of the crossbar connected to the second end of the shaping section; and one end of the crossbar is mounted to the second swivel means.

19. The apparatus of claim 17 wherein further comprises a second set of support members for connecting the frame to the second swivel means, and wherein the frame includes a crossbar and a shaping section, each having a first end and a second end, with the first end of the crossbar connected to the first end of the shaping section and the second end of the crossbar connected to the second end of the shaping section, the crossbar is positioned such that it intersects an imaginary line extending from the first swivel means to the second swivel means; and the sailflag completely rotates about its longitudinal axis without interfering with the first and second stable surfaces and mounting locations.

20. The apparatus of claim 21, wherein the first and second stable surfaces, the first and second mounting locations, the first and second support member sets, and the frame are selected to allow full and unobstructed rotation of the sailflag on the swivels.

* * * * *